US006233757B1

(12) United States Patent
Graham et al.

(10) Patent No.: US 6,233,757 B1
(45) Date of Patent: May 22, 2001

(54) SHOWER NOZZLE CARRIAGE

(75) Inventors: Gary E. Graham, Sheboygan; Michael G. Cook, Kohler, both of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/544,021

(22) Filed: Apr. 6, 2000

(51) Int. Cl.[7] ..... A47K 3/22
(52) U.S. Cl. ..... 4/601; 4/605; 4/615; 4/570
(58) Field of Search ..... 4/601, 605, 615, 4/596, 567, 570; 239/282, 280, 283, 280.5, 722, 750, 752; 248/125.1, 125.2, 132, 149, 429, 424, 230, 416

(56) References Cited

U.S. PATENT DOCUMENTS

| | | | | |
|---|---|---|---|---|
| 2,685,093 | * | 8/1954 | Lundquist | 4/615 |
| 3,005,995 | * | 10/1961 | Bickford | 4/615 |
| 3,321,090 | | 5/1967 | Greenstadt . | |
| 3,737,107 | * | 6/1973 | Wright | 239/588 |
| 4,592,527 | | 6/1986 | Karapita . | |
| 4,978,241 | * | 12/1990 | Lawson | 401/118 |
| 5,035,010 | * | 7/1991 | Sakamoto | 4/567 |
| 5,070,549 | | 12/1991 | Campe . | |
| 5,857,227 | | 1/1999 | Trusty et al. . | |

FOREIGN PATENT DOCUMENTS

| | | | | |
|---|---|---|---|---|
| 1456791 | * | 9/1965 | (FR) | 4/615 |
| 336845 | * | 10/1989 | (FR) | 4/615 |
| 404250232 | * | 9/1992 | (JP) | 4/605 |

* cited by examiner

*Primary Examiner*—Lee Young
*Assistant Examiner*—Huyen Le
(74) *Attorney, Agent, or Firm*—Quarles & Brady LLP

(57) ABSTRACT

Disclosed herein is a shower system having a nozzle supported by a carriage that travels along tracks in a shower tower housing. The carriage includes wheeled components pivotably connected together and biased apart at one end by a spring. It also includes a brake that is urged against a track by the spring to hold the body spray nozzle at a given height. The brake can be released by pulling the body spray nozzle outwardly to compress the spring. The carriage may then be slid vertically along the track to move the body spray nozzle to the desired height. Releasing the body spray nozzle re-engages the brake, which holds the body spray nozzle at the selected height.

8 Claims, 5 Drawing Sheets

FIG. 6
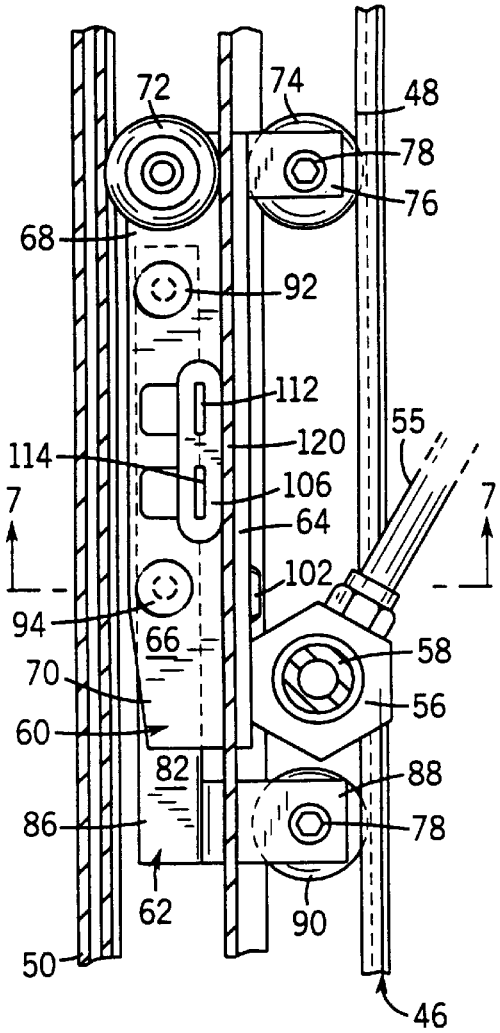
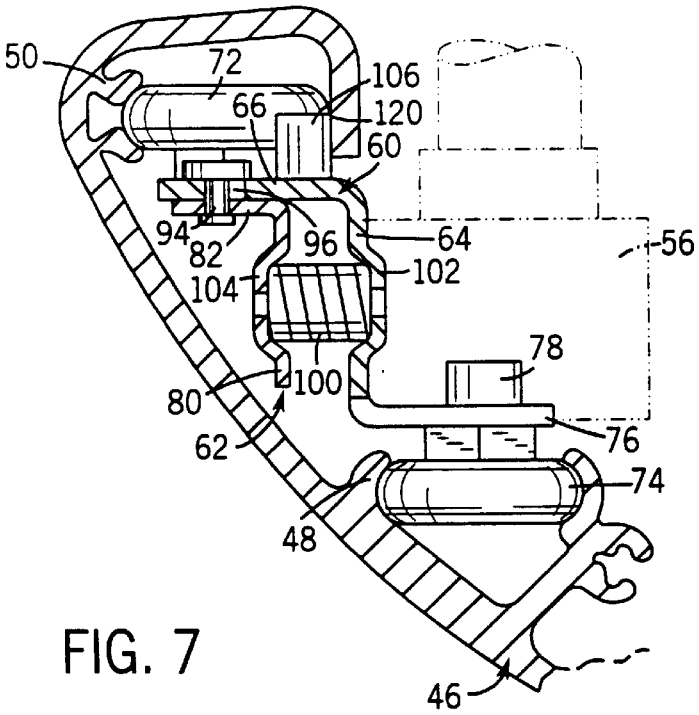
FIG. 7

SHOWER NOZZLE CARRIAGE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to shower systems having vertically adjustable body spray nozzles.

People commonly shower while standing in a tub enclosure or shower stall. The showerhead is usually mounted high on the wall to shower water down upon the person's head and body. Some shower systems also include spray nozzles beneath the main showerhead to spray water laterally toward various parts of the body. Such spray nozzles enhance the showering experience by providing more localized water pressure at targeted muscles and other areas of the body.

Typically such shower systems are vertically fixed at a height that is optimal for average-sized individuals. While such nozzles often can pivot to change the angle of the spray, for very tall adults or young children these standard nozzles will often direct water at undesirable angles. Moreover, a person may wish to more finely adjust the direction of the spray to a particular body region.

It is also known to attach a showerhead to a plumbing supply line via a hose or other flexible conduit to create what is known as a personal shower. The showerhead may be removed from a fixed shower wall mount and held by the hand during showering. However, this requires the bather to assign one hand to holding the spray head. This makes it more difficult to use soap or shampoo, or shave, simultaneously.

In another approach showerheads have been attached to a rod so as to be vertically slidable along the rod. However, these systems typically require the user to loosen and re-tighten fasteners to adjust the height of the showerhead and secure it in the adjusted position.

Other prior art shower systems provide a height adjustment mechanism in which the user can lift or lower a rod supported spout. However, such systems typically require large counter-balancing mechanisms to hold the showerhead at the adjusted position, and thus take up some extra space.

U.S. Pat. No. 5,857,227 discloses a vertically adjustable showerhead where the showerhead is mounted to a bracket behind the shower wall that has rollers which roll within a vertical track. This system holds the showerhead at prescribed heights by stopping the rollers with indentations in the track. As such, the adjustability of the showerhead is still somewhat limited.

Thus, it can be seen that a need still exists for a further improved system for vertically adjusting shower nozzles.

BRIEF SUMMARY OF THE INVENTION

The present invention provides a body spray nozzle that can be adjusted and secured in place at any height along a vertical track. In one aspect the invention provides a shower system having a spray nozzle mounted to a movable carriage and a housing defining a guide along which the carriage travels to position the spray nozzle at different heights. The carriage has a cart with a pivot end and a free end. The cart supports the spray nozzle adjacent the free end and a glide is located adjacent the pivot end for travel along the guide. The cart also includes a brake.

There is also a trailer having one end supporting a glide for travel along the guide and an opposite end being pivotably connected to the pivot end of the cart along a pivot axis. A biasing member urges the free end of the cart into a position so as to normally urge the brake into contact with the guide and thereby fix the carriage axially with respect to the guide. Pulling the spray nozzle so as to move the free end of the cart towards the trailer can release the brake by reducing contact between the brake and guide.

In preferred aspects of the invention the guide has first and second parallel tracks, with the cart glide being disposed within the first track and the trailer glide being disposed within the second track. The cart can further include a second glide in lateral alignment with the first cart glide and in longitudinal alignment with the trailer glide.

In other preferred forms, the glides are all rollers rotatable within tracks of the guide, there is a check limiting the pivot of the cart free end away from the trailer, the biasing member is a compression spring, and the cart and trailer each include a pocket for retaining the spring.

It will be appreciated from the discussion below that the present invention provides a shower system in which body spray nozzles can be easily adjusted to any height along a guide track. The bather can simply pull on the nozzle and slide it to the desired height. Upon release of the nozzle, the nozzles remain at the adjusted height without the need to adjust separate fasteners.

The foregoing and other advantages of the invention will appear from the following description. In this description reference is made to the accompanying drawings which form a part hereof and in which there is shown by way of illustration preferred embodiments of the invention. These embodiments do not represent the full scope of the invention. Thus, the claims should be looked to in order to judge the scope of the invention.

BRIEF DESCRIPTION OF THE DRAWINGS

FIG. 6 is a cross-sectional view taken along line 6—6 of FIG. 3, showing the carriage fixed with respect to the guide track by engagement of a brake to the track;

FIG. 7 is an enlarged cross-sectional view taken along line 7—7 of FIG. 6;

DETAILED DESCRIPTION OF THE PREFERRED EMBODIMENTS

Figure 1:
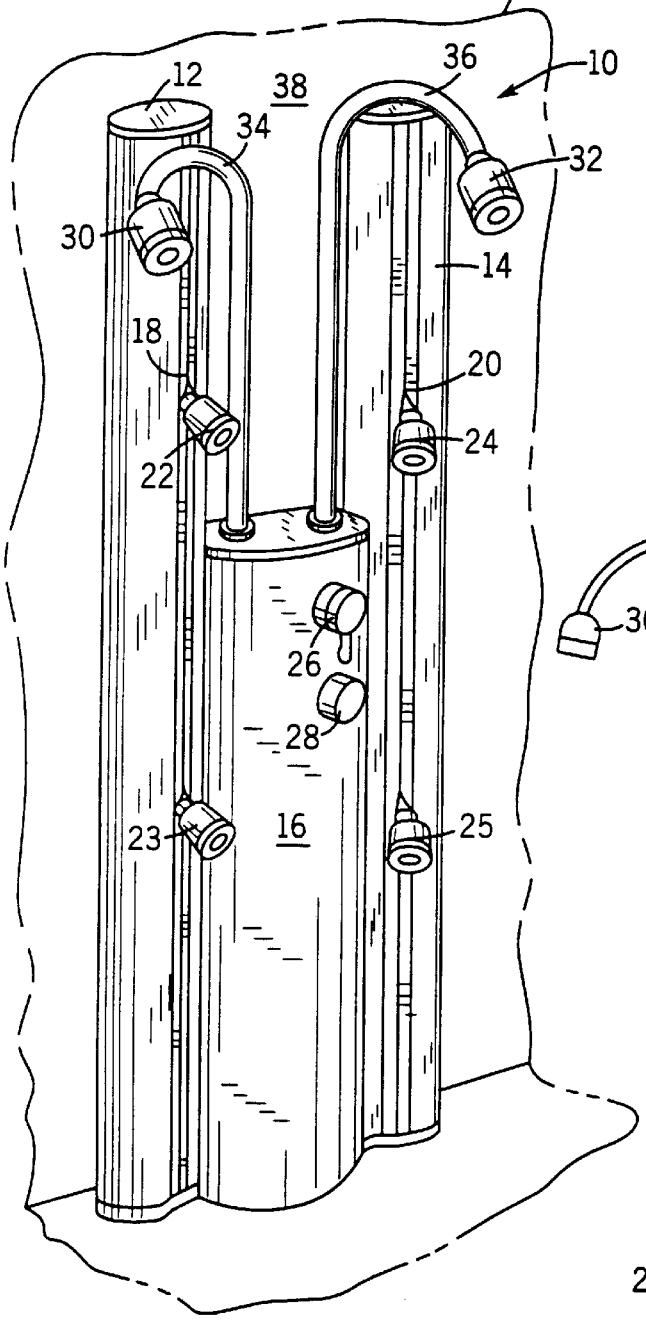
FIG. 1 is a perspective view of a shower system having multiple vertically adjustable spray nozzles according to the present invention.
Figure 2:
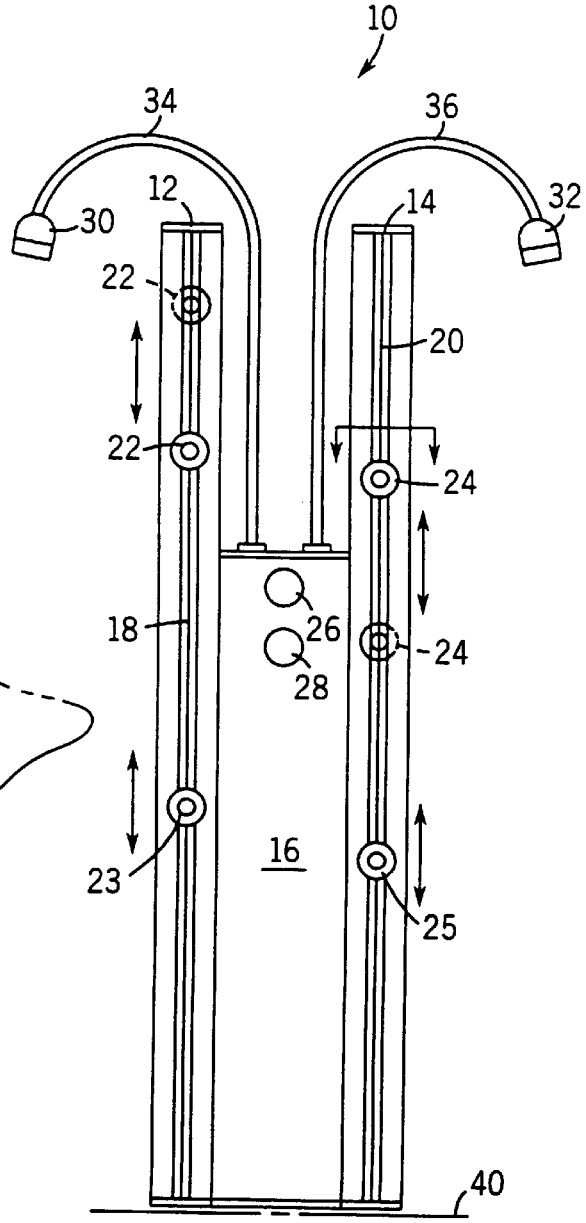
FIG. 2 is a front plan view thereof.

Referring first to FIGS. 1 and 2, a shower tower system 10 of the present invention includes peripheral housings 12 and 14 flanking a main housing 16. The peripheral housings 12 and 14 have vertical slots 18 and 20 for permitting vertical adjustment of horizontal body spray nozzles 22 and 23, and 24 and 25, respectively.

The main housing 16 contains hot and cold water supply lines connected to mixing valve 26, and a diverter valve 28 for selecting between body spray nozzles 22, 23, 24 and 25 and a pair of candy cane showerheads 30 and 32 mounted on adjustable showerhead posts 34 and 36, respectively. The main housing 16 and the column housings 12 and 14 are suitably mounted to a bathroom wall (or alternatively a wall 38 of a shower stall 40).

Each peripheral housing 12 and 14 is generally in the form of a column and has identical components arranged to be in mirror image of each other. Further, each nozzle carriage is identical to the others. As such, for simplicity, only column housing 14 and one body spray nozzle carriage will be described in detail.

Figure 3:
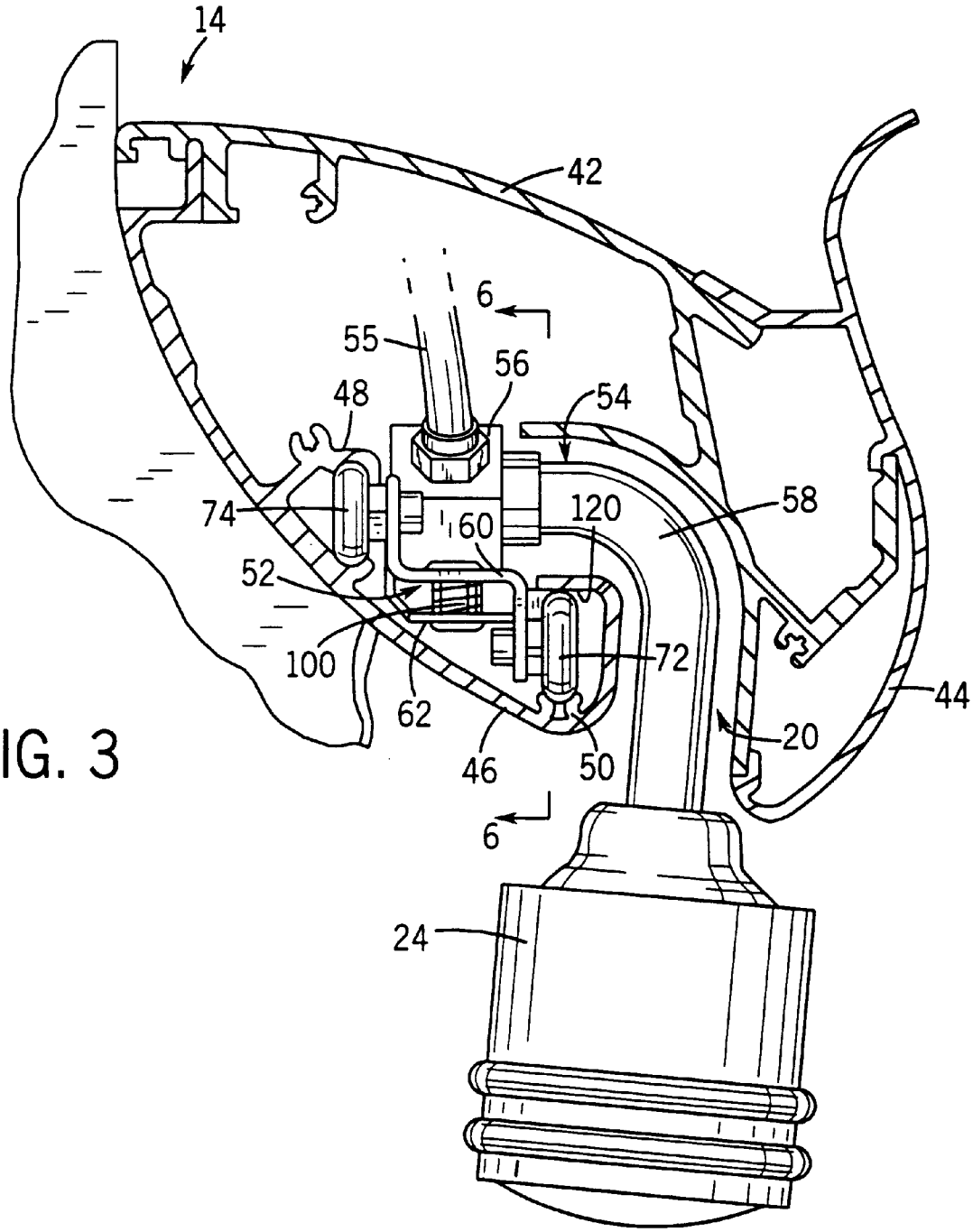
FIG. 3 is a cross-sectional view taken along line 3—3 of FIG. 2, showing a spray nozzle carriage within a guide track.

Referring next to FIG. 3, the peripheral housing 14 includes a wall 42 to which are connected an outer cover 44 and a inner cover 46. The inner cover 46 defines a pair of parallel vertical tracks 48 and 50 and cooperates with the wall 42 to define a vertical slot 20. Preferably, the wall 42 and outer 44 and inner 46 covers are formed from extruded aluminum having the same profile throughout their length.

The body spray nozzle 24 is supported by a carriage 52 movable within the tracks 48 and 50. The body spray nozzle 24 is connected to the carriage 52 by a coupler 54 also having a fitting 56 connectable to a flexible water supply line 55 and a curved neck 58 extending outward between the wall 42 and the inside cover 46 from the fitting 56 to the body spray nozzle 24 outside of the peripheral housing 14.

Figure 5:
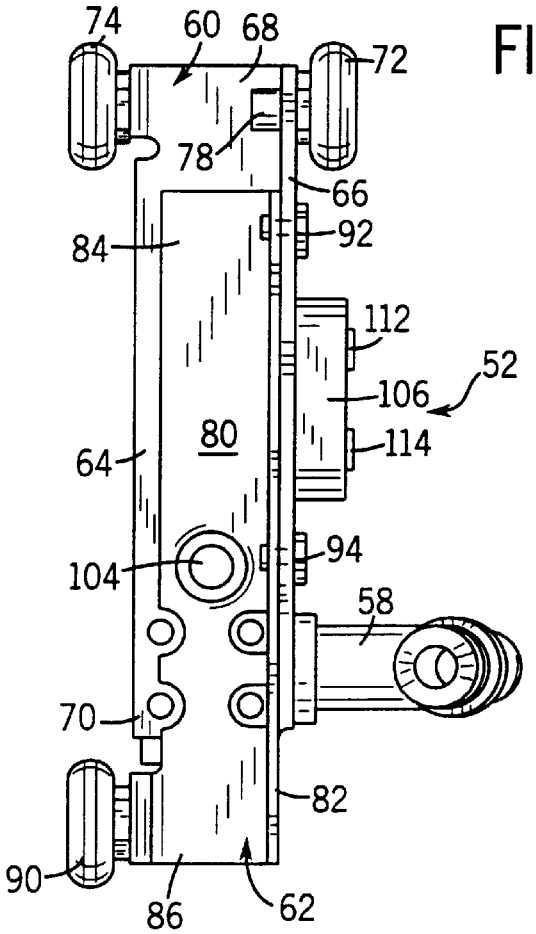
FIG. 5 is a front elevational view of the FIG. 4 spray nozzle carriage.
Figure 4:
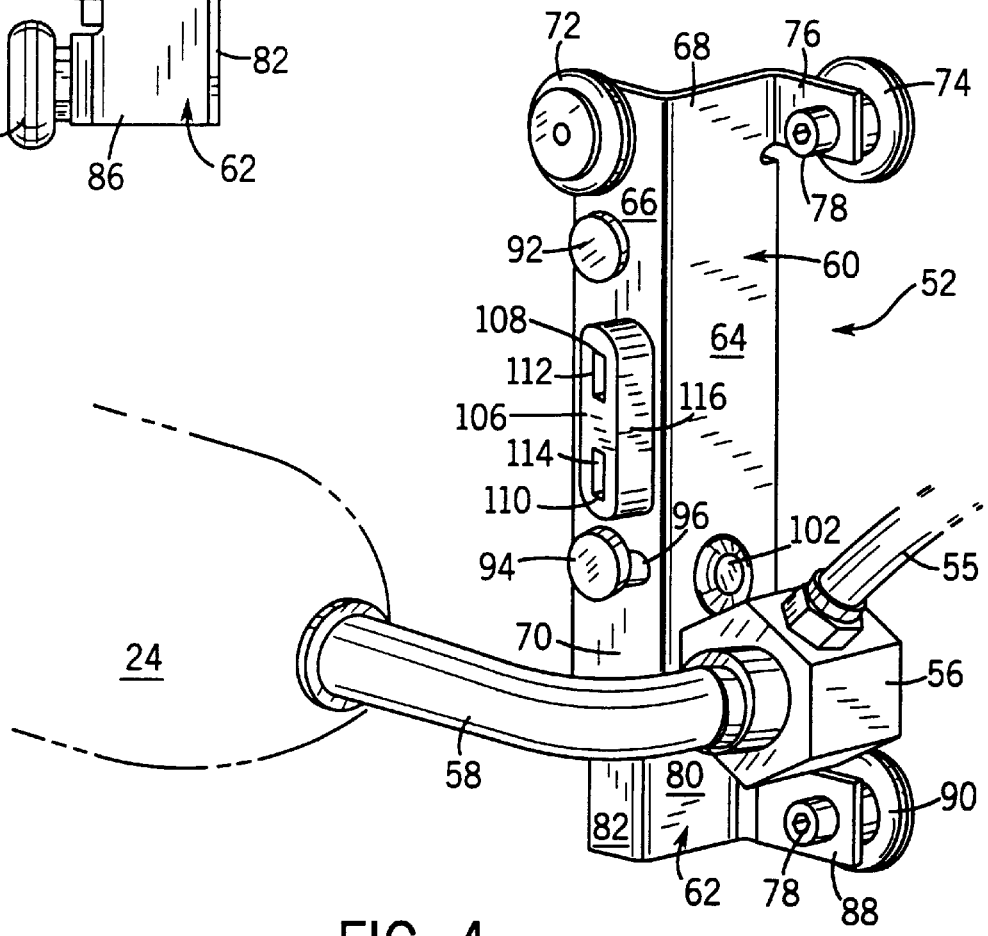
FIG. 4 is a rear perspective view of a spray nozzle carriage of the present invention.

Referring now to FIGS. 4 and 5, the carriage 52 includes a cart 60 and a trailer 62. The trailer is positioned outward of the cart. The cart 60 is an L-cross section shaped stainless steel member having a planar portion 64 and a planar leg 66 extending perpendicularly from the body 64. The cart 60 has a pivot end 68 and a free end 70 to which the coupler 54 is mounted.

At the pivot end 68 the cart 60 has two parallel cart rollers 72 and 74. One is rotatably connected to the leg 66 and the other is connected to a tab 76 extending in the opposite direction as the leg 66, respectively. The cart rollers 72 and 74 are connected to the cart by cap screws 78 and are rotatable about two parallel axes.

The trailer 62 also has an L-cross section. It is slightly smaller and shorter than the cart 60, and has a planar body 80 and a planar leg 82. The trailer 62 also has a pivot end 84 and a free end 86. At the free end 86 is a tab 88 projecting opposite the leg 82 to mount a trailer roller 90 in alignment with cart roller 74, again using a cap screw 78.

The cart 60 and trailer 62 are joined together by their respective legs 66 and 82 at a pivot pin 92, preferably a rivet, extending through openings in the legs 66 and 82 at the cart 68 and trailer 84 pivot ends. The outward pivot of the cart 60 with respect to the trailer 62 is limited by a check pin 94, also preferably a rivet, disposed within a circular opening (not shown) in the trailer leg 82 and an oblong opening 96 in the cart leg 66.

The cart 60 and trailer 62 are biased apart by a spring 100 (see FIG. 3) disposed within respective spring pockets 102 and 104 opening toward each other in the planar bodies 64 and 80. The check pin 94 and spring 100 are located proximate the free ends 70 and 86 of the cart 60 and trailer 62, respectively.

Referring still to FIGS. 4 and 5, the carriage 52 also includes a brake 106, preferably made of rubber. The brake 106 has a pair of slots 108 and 110 that fit onto prongs 112 and 114 projecting from the cart leg 66 between the pivot pin 92 and the check pin 94. The brake 106 is oblong with a flat surface longitudinal surface 116 for contacting a back surface 120 (see FIGS. 6 and 7) of the track 50 when urged by the spring 100.

FIGS. 3, 6 and 7 show the carriage 52 with the cart 60 trailer 62 and rollers 72, 74, 90 rollers disposed within the tracks 48 and 50 and the brake 106 urged in contact with the track 50 by the spring 100. The friction between the brake 106 and the track 50 prevent the carriage 52 (and thereby the body spray nozzle 24) from moving or falling downward in response to gravity.

Figure 8:
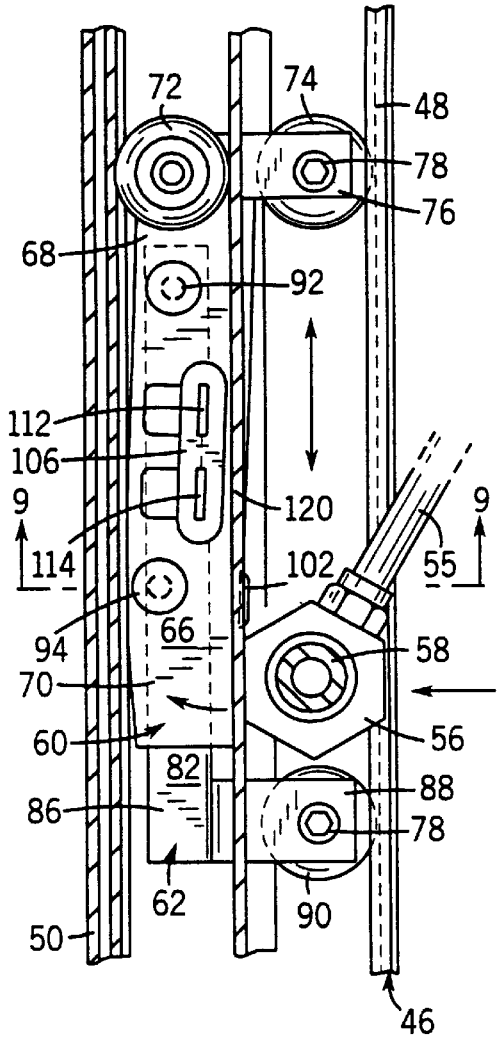
FIG. 8 is a cross-sectional view similar to FIG. 6, albeit with the brake released.
Figure 9:
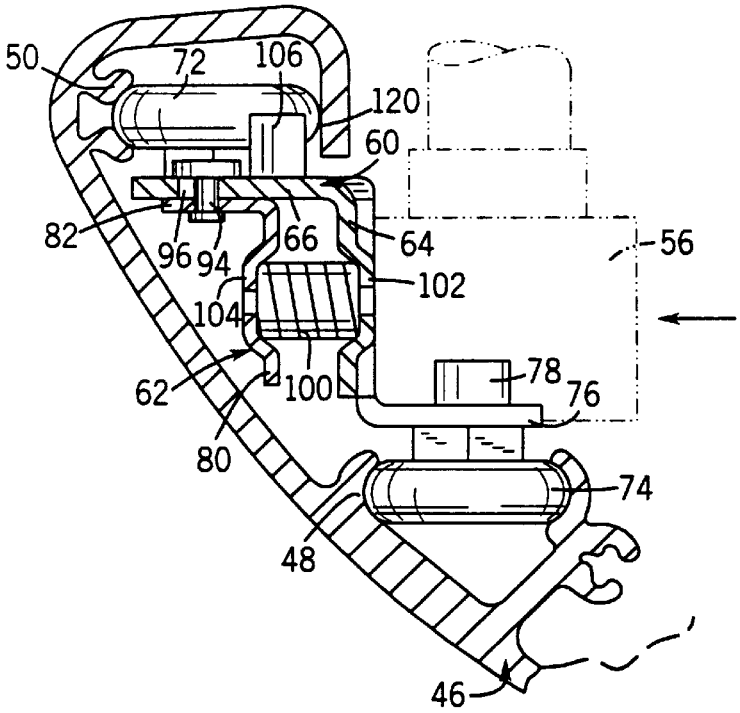
FIG. 9 is an enlarged cross-sectional view taken along line 9—9 of FIG. 8.

FIGS. 8 and 9 show the carriage 52 in the tracks 48 50 with the cart 60 pivoted toward the trailer 62 so as to release the brake 106 from contacting the track 50. The cart 60 is pivoted toward the trailer 62 by applying a sufficient outward pull on the body spray nozzle 24 in opposition to the spring 100. With the brake 106 released, the carriage 52 is free to roll up and down the tracks 48 and 50.

Releasing the body spray nozzle 24 allows the spring 100 to pivot the cart 60 away from the trailer 62 so that the brake 106 re-engages the track 52 so that the body spray nozzle 24 is held at the adjusted position. In this way, the body spray nozzle 52 can be adjusted to any height along the tracks 48 and 50 by simply pulling the body spray nozzle 24 outward, sliding it to the desired height, and letting go.

However, it should be noted that the water lines connect to the fittings 56 of the body spray nozzles 22 and 24 from the top and to the fittings 56 of the lower body spray nozzles 23 and 25 from the bottom.

It will be evident from the above description to those skilled in the art that various changes and modifications can be made to the above described system without departing from the scope of the present invention. For example, it possible for the carriage to include more or less rollers, or for the rollers to be replaced by suitable non-rotatable glides. Moreover, while we have described the shower system as having a pair of body spray nozzles and carriages in each column housing, it is possible to have more or less. Accordingly, to ascertain the full scope of the invention, reference must be had to the following claims.

INDUSTRIAL APPLICABILITY

The above disclosure provides an adjustable shower spray nozzle.

We claim:

1. In a shower system having a spray nozzle mounted to a movable carriage and a housing defining a guide along which a carriage travels to position the spray nozzle at different heights, the carriage comprising:

a cart having a pivot end and a free end, the cart supporting the spray nozzle adjacent the free end and a glide located adjacent the pivot end for travel along the guide, the cart also including a brake;

a trailer having one end supporting a glide for travel along the guide and an opposite end being pivotably connected to the pivot end of the cart along a pivot axis; and a biasing member urging the free end of the cart into a position so as to normally urge the brake into contact with the guide and thereby fix the carriage axially with respect to the guide;

wherein pulling the spray nozzle so as to move the free end of the cart towards the trailer can release the brake by reducing contact between the brake and guide.

2. The shower system of claim 1, wherein the guide comprises first and second parallel tracks.

3. The shower system of claim 2, wherein the cart glide is disposed within the first track and the trailer glide is disposed within the second track.

4. The shower system of claim 3, wherein the cart further includes a second glide in lateral alignment with the first cart glide and longitudinal alignment with the trailer glide.

5. The shower system of claim 4, wherein the glides are all rollers rotatable within tracks of the guide.

6. The shower system of claim 1, further including a check limiting the pivot of the cart free end away from the trailer.

7. The shower system of claim 1, wherein the biasing member is a compression spring.

8. The shower system of claim 7, wherein the cart and trailer each include a pocket for retaining the spring.

* * * * *